US005970211A

United States Patent [19]

Ritsher et al.

[11] Patent Number: 5,970,211

[45] Date of Patent: Oct. 19, 1999

[54] PORTABLE VAPORIZER WITH COOLING CHAMBER

[75] Inventors: Kenneth A. Ritsher, Watertown; Walter G. Birdsell, Marlborough; John E. Longan, Shrewsbury, all of Mass.

[73] Assignee: Honeywell Inc., Minneapolis, Minn.

[21] Appl. No.: 08/908,871

[22] Filed: Aug. 8, 1997

Related U.S. Application Data

[60] Provisional application No. 60/023,950, Aug. 9, 1996.

[51] Int. Cl.[6] ..... A61H 33/12; F22B 1/30

[52] U.S. Cl. ..... 392/403; 392/405; 392/337

[58] Field of Search ..... 392/324, 331, 392/333, 336, 337, 386, 399, 402, 403, 404, 405, 406; 261/108, 109, 110, DIG. 65

[56] References Cited

U.S. PATENT DOCUMENTS

| | | | |
|---|---|---|---|
| 3,570,276 | 3/1971 | Frank | 392/405 |
| 3,654,780 | 4/1972 | Frank | 392/405 |
| 3,809,374 | 5/1974 | Schosso | 392/406 |
| 3,971,913 | 7/1976 | Myklebust | 392/337 |
| 4,463,248 | 7/1984 | Katzman et al. | 392/337 |
| 5,355,591 | 10/1994 | Caruso | 392/386 |

*Primary Examiner*—Teresa Walberg
*Assistant Examiner*—Sam Paik
*Attorney, Agent, or Firm*—Loletta L. Darden

[57] ABSTRACT

A portable vaporizer including a base, a steam stack which includes a baffle and a cup for retaining a liquid, a vented collar, a steam cap and a boiling chamber. The boiling chamber includes a heating element adapted to vaporize a liquid received therein. The vapor exiting the boiling chamber rises through a plurality of openings in the vented collar and mixes with ambient air drawn in through a second set of openings, resulting in a temperature drop in the vapor. The mixture hits the baffle, thus breaking the fluid stream into smaller streams, resulting in a further reduction in the vapor temperature. Consequently, the vapor leaving the vaporizer is at a lower temperature than that discharged from the boiling chamber.

8 Claims, 3 Drawing Sheets

PORTABLE VAPORIZER WITH COOLING CHAMBER

Cross-References to Related Applications

Pursuant to 35 U.S.C. § 119 (e) (1), applicants Kenneth A. Ritsher, Walter G. Birdsell and John E. Longan claim the benefit of the filing date of a provisional application filed on their behalf in the U.S. Patent and Trademark Office on Aug. 9, 1996, entitled Steam Stack with Baffle for Use with Vaporizer and assigned serial number 60/023,950.

BACKGROUND OF THE INVENTION

This invention relates to a vaporizer, and more particularly to an electric vaporizer which permits the vapor to cool before being discharged to the surrounding environment.

Steam vaporizers generally comprise a pair of opposed electrodes in communication with an electrical power source. The electrodes are generally housed in a boiling chamber containing a quantity of water or some other liquid. The electrodes are immersed in the water, which creates a resistance between the two electrodes. Passing an electrical current between the electrodes heats the water to its vaporization temperature, 100° C. This hot vapor exits the boiling chamber and discharges into the surrounding environment.

Typically one uses a vaporizer to help relieve cold and flu symptoms or to add moisture to a living environment. The elevated temperature of the vapor may result in steam burns to persons or animals that come in contact with the vapor as it is discharged from the vaporizer. The present invention overcomes this problem by providing a structure for cooling the vapor before discharging it into the environment.

SUMMARY OF INVENTION

The invention relates to a portable electric vaporizer. The vaporizer includes a base, a steam stack which contains a baffle and a medicine cup, a vented collar, a steam cap and a boiling chamber which receives a pair of electrodes. The steam stack attaches to the vented collar which is mounted over a steam nozzle formed on the steam cap.

As the vapor enters the steam stack, the baffle, which is removably mounted inside the steam stack, disrupts its flow path. The vapor streams hit and bounce off the baffle, forming smaller vapor streams. These smaller vapor streams flow over the surfaces of the baffle and up through the steam stack.

When the vapor stream contacts the baffle, the vapor flow becomes slightly turbulent. This turbulent flow pattern, combined with the natural upward flow of the vapor, draws cooler ambient air into the steam stack through the vented collar. These two gas streams mix in the steam stack, causing a reduction in the temperature of the vapor discharged from the vaporizer relative to that exiting the boiling chamber.

A portion of the hot vapor stream flows up and underneath the cup, increasing the temperature of the cup and resulting in the vaporization and dispersal into the surrounding air the substance placed therein.

It is an object of this invention to provide a vaporizer having a cooling chamber which permits the vapor to cool before exiting the vaporizer.

It is another object of this invention to provide a vapor flow pattern which permits a portion of the hot vapor to increase the temperature of the medicine cup and its contents.

These and other objects of the invention will be better understood by reference to the drawings, detailed description and the claims.

DETAILED DESCRIPTION

This invention relates to an electric vaporizer that effectively humidifies a room. The vaporizer comprises a base, a steam stack that includes an internal baffle and a medicine cup, a vented collar, a steam cap and a boiling chamber. The steam stack is removably mounted over the vented collar, and covers the steam outlet of the boiling chamber where the steam temperatures tend to be the highest. As the vapor rises in the steam stack, it mixes with cooler ambient air drawn into the steam stack, resulting in a reduction in the vapor temperature.

Figure 1:
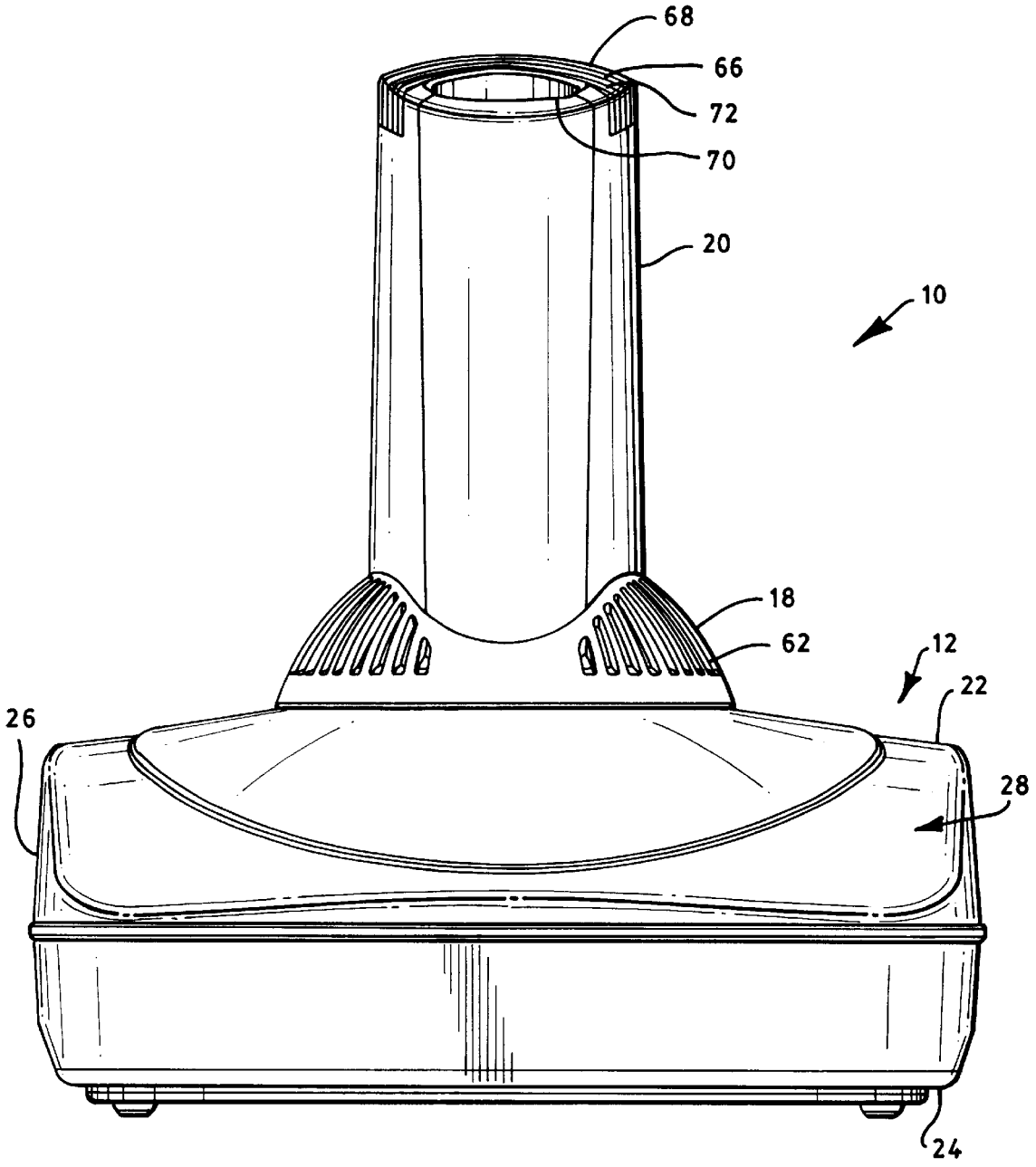
FIG. 1 shows a front perspective view of a vaporizer formed in accordance with the teachings of this invention.
Figure 2:
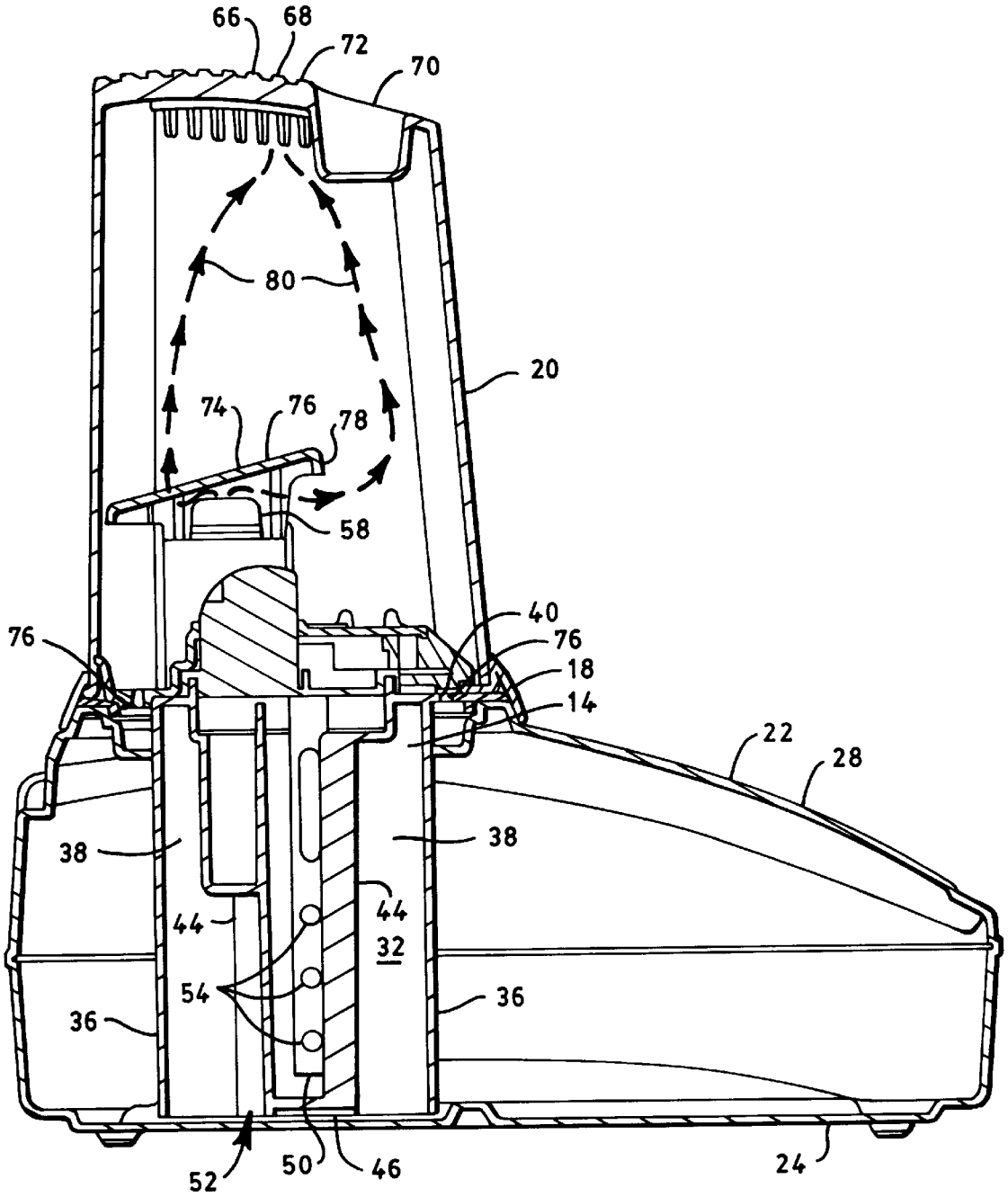
FIG. 2 is a section view of the vaporizer shown in FIG. 1.
Figure 3:
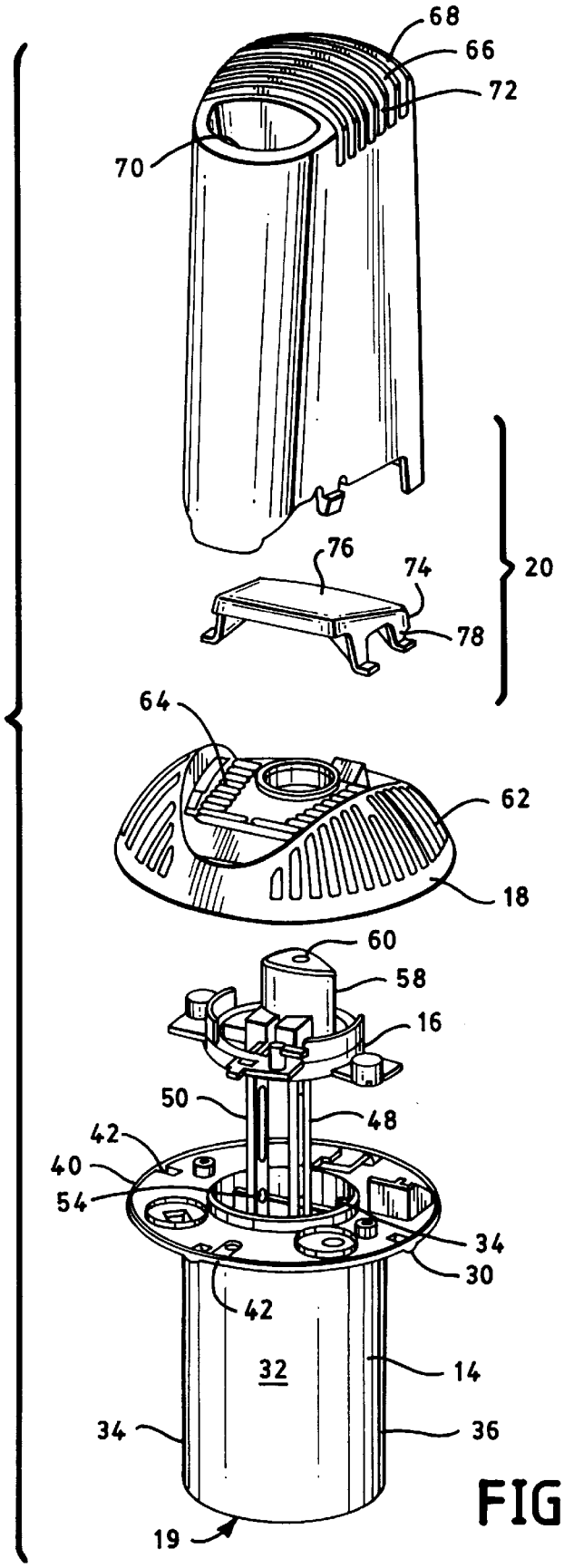
FIG. 3 is an exploded view of the vaporizer shown in FIG. 1.

Turning now to the drawings for a fuller explanation of the invention, the vaporizer 10 illustrated in FIGS. 1, 2 and 3 comprises a base 12, a boiling chamber 14, a pair of electrodes 48 and 50, a vented collar 18, a steam cap 16 and a steam stack 20. The base 12 forms a reservoir 22 for retaining a quantity of water or other suitable liquid. The reservoir 22 includes bottom 24, sidewall 26 and top 28 surfaces. The top surface 28 defines an opening, not shown, which receives the boiling chamber 14. The top surface 28 also defines a plurality of detents, not shown, each of which frictionally engages the boiling chamber 14.

As shown in FIG. 2, the boiling chamber 14 is positioned inside the reservoir 22, and includes locating lugs 30 which horizontally and vertically position the boiling chamber 14 over the base 12. Once in place on the base 12, the boiling chamber 14 is rotated so that detents, not shown, formed on the sidewall surface 36 detachably engage the base 12, thus creating a latching arrangement that secures the boiling chamber 14 to the base 12.

The boiling chamber 14 also includes a cylindrical surface 32 that defines a top surface, bottom surface and sidewall surface 36. The cylindrical surface 32 also defines a hollow center 34 which extends the length of cylindrical surface 32, forming an open center in the top and bottom surfaces.

The sidewall surface 36 forms an air pocket 38 around the hollow center 34. This air pocket 38 helps to dissipate heat generated in the boiling chamber 14. The sidewall surface 36 terminates at the top surface in an annular flange 40. The annular flange 40 defines a plurality of condensation drain holes 42 that permits the drainage of condensate into the reservoir 22.

A downwardly projecting side surface 44 joined by bottom surface 46 encloses the hollow center 34. The downwardly projecting surface side 44 is parallel to the sidewall surface 36. The downwardly projecting surface side 44 and the bottom surface 46 form a protective housing 52 for the electrodes 48 and 50. The electrode housing 52 is concentric with and parallel to the boiling chamber 14. The bottom surface 46 includes a plurality of openings, not shown, which permits the flow of a quantity of water into the electrode housing 52.

The electrodes 48 and 50 are received in the electrode housing 52, and are formed from stainless steel or another corrosion resistant material. The preferred material is No. 403 stainless steal because of its hardness and corrosion resistant properties. The electrodes 48 and 50 include a plurality of vent holes 54 formed in the vertical portion of each electrode 48 and 50. These vent holes 54 help to reduce foaming of the water between the electrodes 48 and 50. The vent holes 54 also provide additional contact surface area for heating the water.

The upper end of the electrodes 48 and 50 pass through parallel slots, not shown, defined by the steam cap 16. The electrodes 48 and 50 frictionally engage the slots, thereby disengagably securing the electrodes 48 and 50 in position in the steam cap 16. The upper ends of the electrodes 48 and 50 and the slots are covered with a waterproof sealant. The sealant, once cured, strengthens the engagement between the electrodes 48 and 50 and the slots. The sealant also prevents water or other condensation from draining back into the electrode housing 52.

The steam cap 16 completely encloses the electrodes 48 and 50, preventing accidental contact therewith. The steam cap 16 includes a pair of screw bosses each of which receives screws for detachably attaching the steam cap 16 to the boiling chamber 14, the vented collar 18 and the steam stack 20. The steam cap 16 also defines a steam nozzle 58. The steam nozzle 58 includes a raised cylindrical surface which protrudes from the surface of the steam cap 16. The steam nozzle 58 forms a small aperture 60 through which vapor exits the boiling chamber 14 and rises up through the vented collar 18 and into the steam stack 20.

The vented collar 18 disengagably attaches to the steam cap 16, and defines a central opening which r receives the steam nozzle 58. The vented collar 18 defines a plurality of air inlets 62 that open to ambient conditions, and a plurality of openings 64 that channel the ambient air up through the steam stack 20.

The steam stack 20 is an elongated rectangular structure having a vapor discharge outlet 66 formed on its top surface 68. A grill 72 covers the discharge outlet 66. The grill 72 prevents the accidental insertion of objects into the steam stack 20.

The steam stack 20 also includes a medicine cup 70 formed on its top surface 68 opposite the discharge opening 66. The medicine cup can be used to disperse into the surrounding air a medicant placed therein. In a preferred embodiment of the vaporizer 10, the medicine cup 70 and the steam stack 20 form a unitary structure.

The steam stack 20 also includes the baffle 74. The baffle 74 is an inverted cup shaped member that includes a horizontal top surface 76 and vertical side surfaces 78. The baffle 74 is angularly positioned inside the steam stack 20, and is disengagably attached to raised surfaces, not shown, formed on opposite interior walls of the steam stack 20.

OPERATION

The vaporizer 10 receives operating current via a conventional insulated conductive wire, not shown, having a conventional plug, not shown, attached to one end. The plug connects to a conventional household electrical outlet such as a 110 VAC or 220 VAC supply.

When the "on/off" switch of the vaporizer is in the "on" position and the plug is connected to the power supply, electrical conductors, not shown, deliver an electrical current to the electrodes 48 and 50. The conductors are attached to the electrodes 48 and SO using commonly known techniques. When water is in the boiling chamber and the vaporizer is on, an electrical current passes between the electrodes, vaporizing the water between them and causing the discharge of hot vapor from the steam nozzle 58.

As the vapor exits the steam nozzle 58, it contacts the baffle 74 that extends into the vapor flow path. The baffle 74 redirects the vapor flow path as illustrated by the lines 80 shown in FIG. 2. The baffle forces the vapor to flow around the surfaces 76 and 78. As the vapor bounces off the baffle 74, it breaks up into smaller vapor streams. The angular placement of the baffle 74 directs most of the vapor steams toward the front of the steam stack 20, such that the vapor rises up and underneath the medicine cup 70. This effectively warms the medicant in the medicine cup 70. The medicine cup 70 serves as a secondary baffle, causing a further separation of the vapor steams that come into contact with it.

The vapor exits the top of the steam stack 20 through the grill 72. At the grill 72, the vapor temperature is significantly lower than the temperature of the vapor exiting the steam nozzle 58. This is because the baffle 74 breaks up the hot columns of vapor that otherwise would have risen directly up and out of the steam stack 20.

Additionally, when the vapor streams hit the baffle, the flow becomes slightly turbulent. The turbulent vapor flow, combined with the natural tendency of vapor to rise, creates a slight pressure drop in the steam stack 20. This pressure differential draws cooler ambient air into the steam stack 20 through the inlet openings 62. The vapor and ambient air mix in the steam stack 20, thus causing a reduction in the steam temperature.

Drains 76 formed in the steam stack 20 permit condensation formed on the baffle 74 and inside the steam stack 20 to drip back into the water reservoir 22.

From the above discussion, it is clear that the vaporizer 10 includes a novel arrangement of components that permits the vapor to cool before it is discharged from the vaporizer. The embodiment of the vaporizer described herein is for illustrative purposes. Obviously many variations and modifications of the invention are possible in light of the above teachings. For example, the steam stack, baffle and vented collar could be formed as a single structure. It is to be understood therefore that the invention can be practiced other than as specifically described.

We claim:

1. A vaporizer comprising:

a base defining a reservoir for retaining a liquid;

a boiling chamber comprising a housing which defines a hollow center, a top surface defining a vapor outlet, a bottom surface and a sidewall surface, the boiling chamber is received in and detachably mounted to the base such that liquid from the reservoir is received in the boiling chamber;

a heating element received within the hollow center of the boiling chamber and adapted to induce evaporation of liquid in the boiling chamber;

a vented collar disengagably mounted over the top surface of the boiling chamber, the vented collar defines a plurality of ambient air openings and a second plurality of openings juxtaposed thereto;

a steam stack detachably mounted to the vented collar, the steam stack comprises a top surface defining a vapor outlet and a sidewall surface defining an open bottom and a hollow center; and a baffle received in the hollow center of the steam stack, whereby evaporated liquid exiting the boiling chamber rises through the second plurality of openings in the vented collar and mixes with ambient air drawn in through the ambient air openings, thus resulting in a temperature drop in the vapor; the mixture contacts the baffle, breaking the fluid stream into smaller fluid streams, resulting in a second temperature drop in the vapor.

2. The heating element defined in claim 1 wherein the heating element comprises a pair of electrodes.

3. The steam stack defined in claim 1 further comprising a medicine cup formed in the top surface adjacent the vapor outlet.

4. The steam stack defined in claim 1 further comprising an outlet grill mounted over the vapor outlet.

5. The baffle defined in claim 1 wherein the baffle is angularly positioned and detachably mounted inside the steam stack.

6. A vaporizer comprising:

a base defining a reservoir for retaining a liquid;

a boiling chamber comprising a housing which defines a hollow center, a top surface defining a vapor outlet, a bottom surface and a sidewall surface, the boiling chamber is received in and detachably mounted to the base such that liquid from the reservoir is received in the boiling chamber;

a heating element received within the hollow center of the boiling chamber and adapted to induce evaporation of liquid in the boiling chamber;

a steam cap mounted to an upper end of the heating element and detachably mounted over the top surface of the boiling chamber, the steam cap defines a vapor discharge opening that is in fluid communication with the boiling chamber;

a vented collar mounted over the steam cap, the vented collar defines a plurality of ambient air openings and a second plurality of openings juxtaposed thereto;

a steam stack detachably mounted to the vented collar, the steam stack comprises a top surface defining a vapor outlet and a sidewall surface defining an open bottom and a hollow center; and a baffle received in the hollow center of the steam stack.

7. The heating element defined in claim 6 wherein the heating element comprises a pair of electrodes.

8. The steam stack defined in claim 6 further comprising a medicine cup formed in the top surface adjacent the vapor outlet.

* * * * *